US010557371B2

(12) United States Patent
Ruberte Sanchez

(10) Patent No.: US 10,557,371 B2
(45) Date of Patent: Feb. 11, 2020

(54) GAS TURBINE ENGINE VARIABLE VANE END WALL INSERT

(71) Applicant: United Technologies Corporation, Farmington, CT (US)

(72) Inventor: Jose E. Ruberte Sanchez, Jupiter, FL (US)

(73) Assignee: United Technologies Corporation, Farmington, CT (US)

( * ) Notice: Subject to any disclaimer, the term of this patent is extended or adjusted under 35 U.S.C. 154(b) by 320 days.

(21) Appl. No.: 15/649,946

(22) Filed: Jul. 14, 2017

(65) Prior Publication Data

US 2019/0017408 A1 Jan. 17, 2019

(51) Int. Cl.

| | |
|---|---|
| ***F01D 17/16*** | (2006.01) |
| ***F01D 25/16*** | (2006.01) |
| ***F01D 11/00*** | (2006.01) |
| ***F04D 29/56*** | (2006.01) |

(52) U.S. Cl.

CPC ..... *F01D 17/162* (2013.01); *F01D 11/005* (2013.01); *F01D 25/16* (2013.01); *F04D 29/563* (2013.01); *F05D 2220/32* (2013.01); *F05D 2260/30* (2013.01); *F05D 2260/38* (2013.01)

(58) Field of Classification Search

CPC ..... F01D 17/162; F04D 29/563

See application file for complete search history.

(56) References Cited

U.S. PATENT DOCUMENTS

| | | | | |
|---|---|---|---|---|
| 2,919,890 | A | | 1/1960 | Smith et al. |
| 3,542,484 | A | * | 11/1970 | Mason ..... F01D 17/162 415/160 |
| 6,887,035 | B2 | | 5/2005 | Bruce |
| 7,112,039 | B2 | | 9/2006 | Brooks |
| 7,220,098 | B2 | | 5/2007 | Bruce et al. |
| 8,517,661 | B2 | | 8/2013 | Schilling |
| 9,074,489 | B2 | | 7/2015 | Eleftheriou et al. |
| 2006/0245916 | A1 | | 11/2006 | Foucher |
| 2012/0272656 | A1 | | 11/2012 | Norris |
| 2013/0243580 | A1 | | 9/2013 | Hayford et al. |
| 2014/0234110 | A1 | | 8/2014 | Puram et al. |
| 2015/0167490 | A1 | | 6/2015 | Hennequin et al. |
| 2015/0354400 | A1 | | 12/2015 | Teixeira |
| 2016/0237845 | A1 | | 8/2016 | Teixeira et al. |

FOREIGN PATENT DOCUMENTS

| | | |
|---|---|---|
| EP | 1400659 A1 | 3/2004 |
| EP | 1959094 A2 | 8/2008 |
| GB | 2060782 A | 5/1981 |

OTHER PUBLICATIONS

European Search Report for European Application No. 18182317.0 dated Aug. 10, 2018.

* cited by examiner

*Primary Examiner* — Igor Kershteyn
*Assistant Examiner* — Brian O Peters
(74) *Attorney, Agent, or Firm* — Carlson, Gaskey & Olds, P.C.

(57) ABSTRACT

A variable vane assembly for a gas turbine engine includes a case having a bore and a recess. The case provides a first portion of a flow path surface. A vane includes a journal that extends along an axis from a vane end and received in the bore. An insert is arranged in the recess and provides a second portion of the flow path surface adjacent to the first flow path surface. The insert includes a pocket that slidably receives the vane end. The vane end is configured to move axially relative to the insert.

19 Claims, 5 Drawing Sheets

GAS TURBINE ENGINE VARIABLE VANE END WALL INSERT

STATEMENT REGARDING FEDERALLY SPONSORED RESEARCH OR DEVELOPMENT

This invention was made with government support under Contract No. FA8650-15-D-2502 awarded by the United States Air Force. The Government has certain rights in this invention.

BACKGROUND

This disclosure relates to variable stator vanes and their components with respect to flowpath case structure.

Latest aircraft requirements have created challenges for the jet engine manufacturers. In order to meet these requirements, jet engines are incorporating adjustable features to enable variable cycle engines. One example is variable vanes in the turbine section, which could move (rotate) to vary the flow area of the turbine.

Variable Area Turbines (VATs) are an adaptive component which, when coupled with other adaptive engine features such as adaptive fans, compressors with variable vanes, variable nozzles, etc. can yield significant benefits in overall gas turbine engine performance. Such benefits may include but are not limited to reduced specific fuel consumption (SFC), reduced high pressure compressor discharge air temperature at take-off conditions, improved throttle response, and improved part life.

The VATs function is to provide a change in the turbine flow parameter by changing turbine flow area, for example. Varying turbine flow area may be achieved by rotating a plurality of the individual vane airfoils in a first stage of the turbine. In order to minimize turbine vane performance debits associated with rotating the variable vane airfoil, measures should be taken to minimize the areas of concern. These areas include, for example, varying cooling flow requirements, leakage flow, and variable vane hardware gaps. One of the critical variable vane hardware gaps that should be minimized is the gap between a rotating variable vane endwall and the inner and outer diameter flowpaths. Minimizing this gap will help reduce the amount of hot gas that can pass from the pressure side to the suction side of the vane airfoil, thus improving turbine performance and the durability of the variable vane airfoil itself.

In one example configuration, the variable vane is rotated within a cylindrical inner and outer diameter flowpath. During rotation the variable vane endwall gaps change. When the variable vane airfoil is rotated from a nominal position, the gap between the vane outer diameter endwall edges and the outer diameter flowpath surfaces decreases. To avoid clashing, the variable vane nominal endwall gap at the outer diameter must be increased. However, increasing this gap can result in an increase in the hot gas migration under the vane endwalls from the pressure side to the suction side of the variable vane, reducing turbine performance and airfoil durability.

Further, as the variable vane is rotated from the nominal position the gap between the vane inner diameter endwall edges and the inner diameter flowpath increases. Increasing this gap can also result in an increase in the hot gas migration under the vane endwalls from the pressure side to the suction side of the vane. These adverse effects are even more severe for a vane that rotates within conical inner and/or outer diameter flowpaths.

SUMMARY

In one exemplary embodiment, a variable vane assembly for a gas turbine engine includes a case having a bore and a recess. The case provides a first portion of a flow path surface. A vane includes a journal that extends along an axis from a vane end and received in the bore. An insert is arranged in the recess and provides a second portion of the flow path surface adjacent to the first flow path surface. The insert includes a pocket that slidably receives the vane end. The vane end is configured to move axially relative to the insert.

In a further embodiment of any of the above, the insert includes opposing sides. The pocket is provided on one side and a neck is provided on the other side and includes an aperture through which the journal extends. The neck has a portion that extends radially inward into the aperture to provide a first face. The journal includes a collar that provides a second face. A spring is arranged between the first and second faces and is configured to bias the insert and the vane end apart from one another.

In a further embodiment of any of the above, a circumferential groove is provided in the portion of the neck opposite the aperture. A piston seal is received in the groove and engages the bore.

In a further embodiment of any of the above, a bearing or a bushing is in the bore and supports the journal for rotation relative to the case.

In a further embodiment of any of the above, the first and second portions of the flow path surfaces are flush with one another.

In a further embodiment of any of the above, a fillet circumscribes at least some of the pocket on a side of the insert. The fillet provides a transition from the second portion of the flow path surface to an exterior airfoil surface of the vane.

In a further embodiment of any of the above, the fillet provides at least one of a leading edge airfoil fillet and a trailing edge airfoil fillet.

In a further embodiment of any of the above, the insert is a different material than the vane.

In a further embodiment of any of the above, the case includes radially spaced apart inner and outer cases. The vane has opposing ends. Each of the inner and outer cases include the recess. The insert is provided in each of the recesses with the pocket in the recess receiving a respective one of the opposing ends.

In another exemplary embodiment, an insert for a variable vane assembly includes a body that has a circular periphery with opposing sides. A pocket is provided on one side and a neck is provided on the other side and includes an aperture. The neck has a portion that extends radially inward into the aperture to provide an annular face. A circumferential groove is provided in the portion of the neck opposite the aperture.

In a further embodiment of any of the above, a fillet circumscribes at least some of the pocket on the one side.

In a further embodiment of any of the above, the fillet is interrupted at the aperture.

In a further embodiment of any of the above, the fillet provides a leading edge airfoil fillet.

In a further embodiment of any of the above, the fillet provides a trailing edge airfoil fillet.

In a further embodiment of any of the above, the neck is cylindrical in shape.

In a further embodiment of any of the above, a piston seal is received in the circumferential groove.

In a further embodiment of any of the above, the insert is constructed from a ceramic material.

In another exemplary embodiment, a method of operating a variable vane assembly includes rotatably receiving a journal of a vane and an insert in a case. The vane and insert are configured to rotate together with respect to the case. The insert and the case together provide a flow path surface. The insert and the vane are biased radially apart with the end of the vane slidably received in a pocket of the insert.

In a further embodiment of any of the above, the insert is sealed with respect to the case.

In a further embodiment of any of the above, the journal is carried with respect to the case with a bearing or bushing.

BRIEF DESCRIPTION OF THE DRAWINGS

The disclosure can be further understood by reference to the following detailed description when considered in connection with the accompanying drawings wherein.

DETAILED DESCRIPTION

Figure 1:
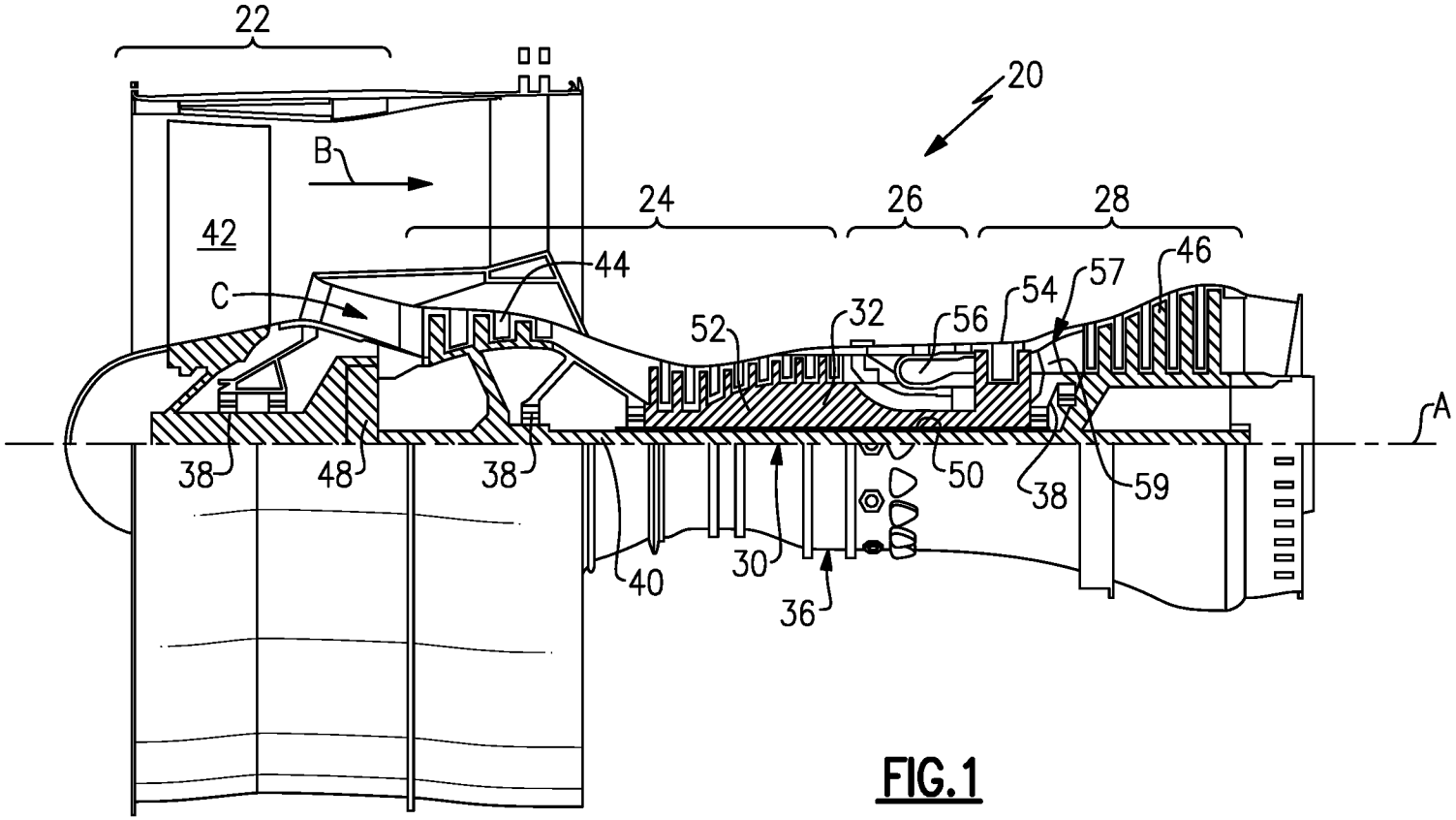
FIG. 1 schematically illustrates a gas turbine engine embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of

[(Tram ° R)/(518.7° R)]$^{0.5}$. The "Low corrected fan tip speed" as disclosed herein according to one non-limiting embodiment is less than about 1150 ft/second (350.5 meters/second).

Figure 4A:
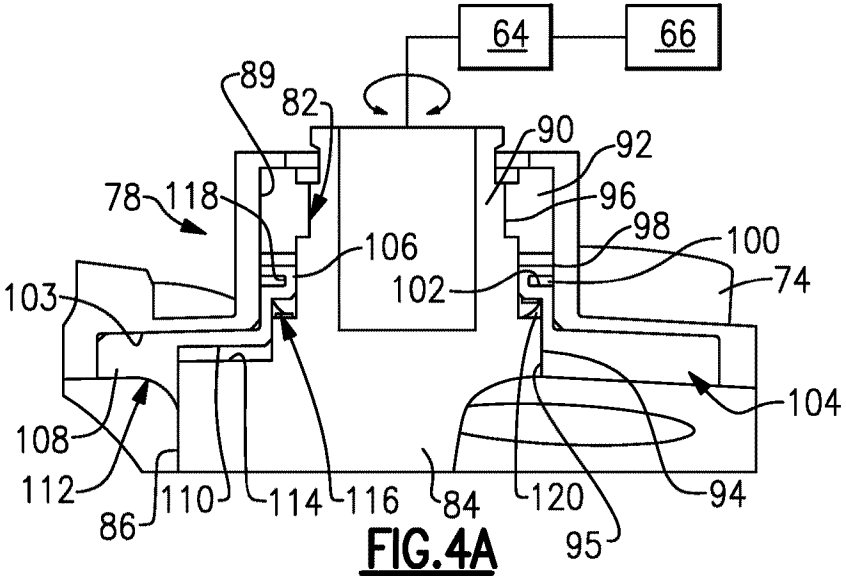
FIG. 4A is a cross-sectional view through the variable vane shown in FIG. 3 taken along line 4A-4A.
Figure 2:
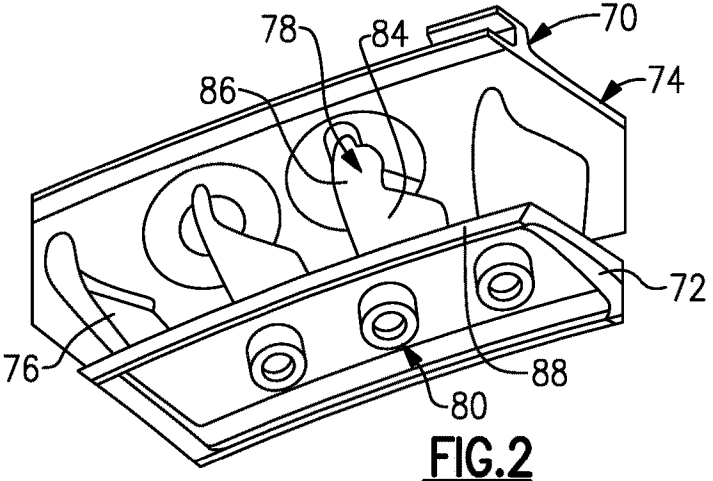
FIG. 2 is a perspective view of a portion of a turbine section with variable vanes.
Figure 5A:
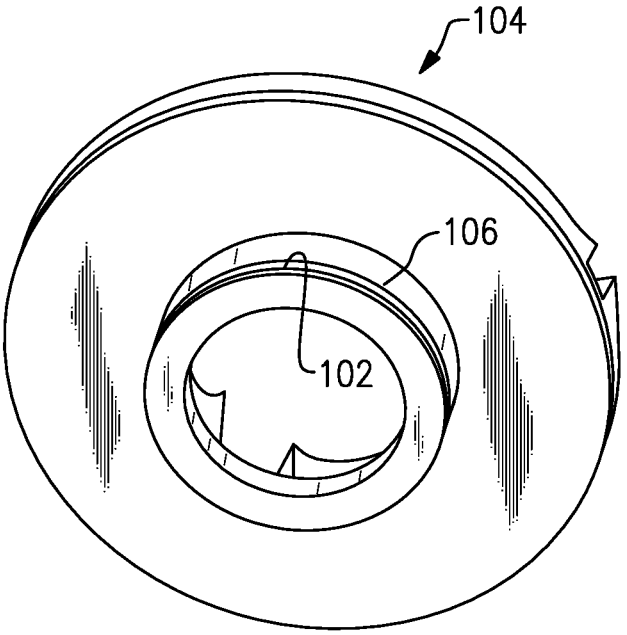
FIGS. 5A and 5B are perspective views of an insert used to support an end of the variable vane.
Figure 5B:
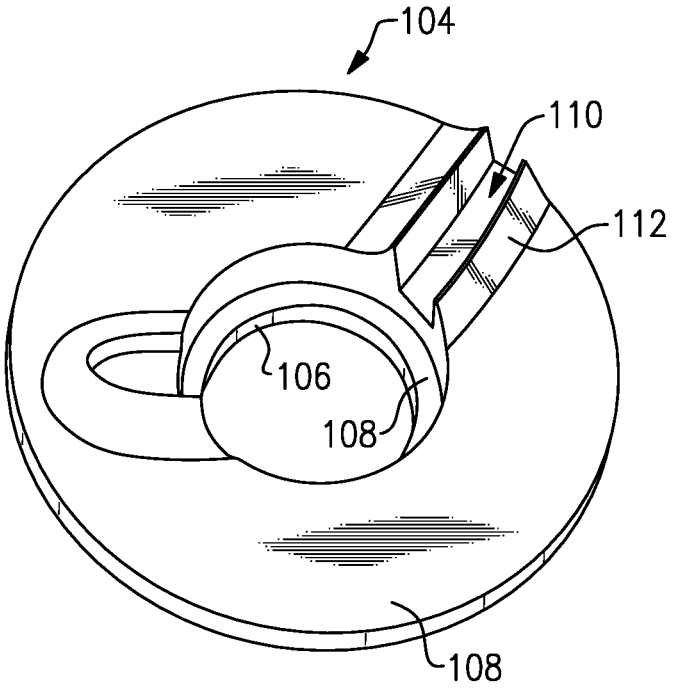

Referring to FIG. 2, the engine static structure 70 includes radially spaced apart inner and outer cases 72, 74. The inner and outer cases 72, 74 are joined to one another with circumferentially spaced apart fixed vanes 76 (only one shown). Variable vanes 78 are provided between the inner and outer cases 72, 74 and are rotatable about an axis, which is oriented in a generally radial direction with respect to the engine centerline axis $C_L$, in response to commands from a controller 66 to an actuator 64 coupled to the variable stator vane 78 (FIG. 4A).

The variable stator vanes 78 are supported for rotation with respect to the inner and outer cases 72, 74 by inner and outer bearing and/or bushing 80, 82 respectively. The variable vanes 78 include an airfoil 84 having leading and trailing edges 86, 88. Any clearances between the airfoil 84 and the inner and outer cases 72, 74 results in leakage past the vanes, which reduces the overall efficiency of the stage. To this end, it is desirable to minimize any of these clearances, particularly during the expansion and contraction of the components within the stage with respect to one another throughout various thermal gradients.

Figure 4B:
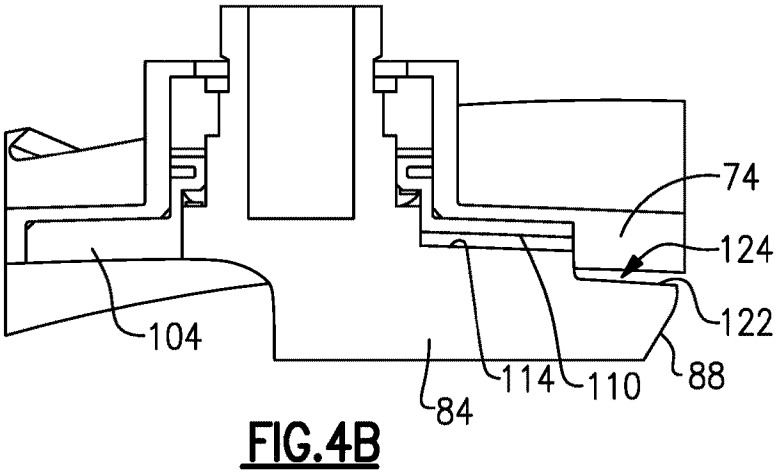
FIG. 4B is a cross-sectional view through the variable vane shown in FIG. 3 taken along line 4B-4B.
Figure 3:
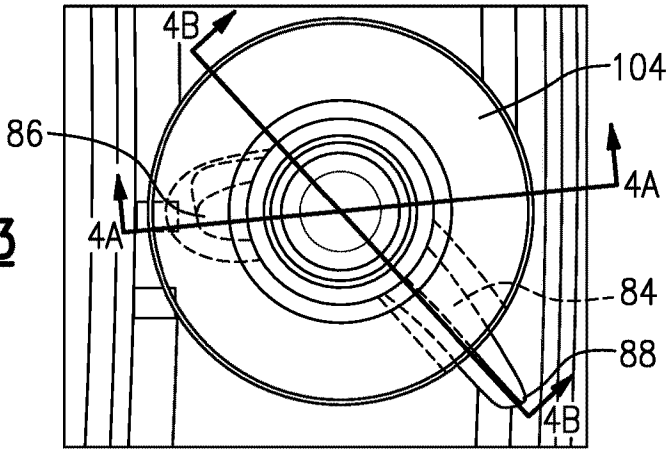
FIG. 3 is an end view of one of the variable vanes shown in FIG. 2.

Referring to FIGS. 3-4B, the variable vane 78 includes a journal 90 at each of opposing ends 114, which are supported by the inner and outer bearing 80, 82. The outer end 114 of the variable stator vane 78 is shown and is exemplary of the configuration at the inner location. The journal 90 includes first and second diameter 96, 98. The outer case 74 includes a bore 89 that supports a bearing or bushing 92 that rotationally supports the first diameter 96.

The outer case 74 includes a recess 103 that receives an insert 104, which supports and seals with respect to the variable vane 78. The variable stator vane 78 and the insert 104 are configured to rotate together with respect to the outer case 74. The outer case 74 provides a first portion of a flow path surface, and the insert 104 provides a second portion of the flow path surface adjacent to the first flow path surface such that the first and second portions of the flow path surfaces are flush with one another.

The insert 104 may be constructed from a different material than the variable stator vane assembly 78. For example, the variable stator vane 78 may be constructed from a nickel alloy (e.g., Inconel), and the insert 104 may be constructed from a ceramic material to help reduce or eliminate the amount of additional cooling air needed to cool the insert 104.

In the example, the insert 104 includes an aperture 95 that receives a collar 94 provided by the end 114 of the variable vane 78. A neck 106, which is cylindrical in shape in the example, extends axially from one side of a flange 108 of the insert 104 that is arranged in the recess 103. A portion of the neck 106 extends radially into the aperture 95 to the second diameter 98. The flange 108 has a circular periphery that permits rotation of the insert 104 within the recess 103. The neck 106 includes a hole through which the journal 90 extends. A circumferential groove 102 is provided in the radially inwardly extending portion of the neck 106 and receives a seal 100, for example, a piston seal, which seals the insert 104 with a respect to the bore 89.

As best shown in FIGS. 4A-5B, the insert 104 includes a pocket 110 that slidably receives the end 114 of the variable vane 78. A fillet 112 may be provided by the insert 104 and provides the transition from the flowpath surface to an exterior airfoil surface of the airfoil 84. In the example, the fillet 112 circumscribes at least some of the pocket 110 on the side facing the flowpath. The fillet 112 may be interrupted at the aperture 95 such that the remaining fillet is provided by the collar 94. The fillet 112 provides at least one of a leading edge airfoil fillet (FIGS. 2-4B and 6A-7) and a trailing edge airfoil fillet (FIG. 7).

The end 114 and the insert 104 have a relatively tight clearance, but axial movement along the variable stator vane's rotational axis between the insert 104 and airfoil 84 is permissible to accommodate thermal expansion and relative movement to the components during engine operation, enabled by pocket 112. Thus, it is desirable to provide a slip fit between the end 114 and the insert 104 at engine operating temperatures.

A spring 116, for example a wave spring, is provided between first and second annular faces 118, 120 of the insert 104 and collar 94, respectively, which biases the insert 104 into sealing engagement with the outer case 74. The biasing force provided by the spring 116 may create a clearance 115 between the variable stator vane 78 and the insert 104 (best shown in FIGS. 6A-6B); however, the depth of the pocket 110 is such that a step is not created between the insert 104 and the variable stator vane 78.

The configuration discussed above with respect to the outer case 74 can also be incorporated to the inner case 72 such that the insert arrangement is provided at both ends of the variable stator vane 78.

Figure 6B:
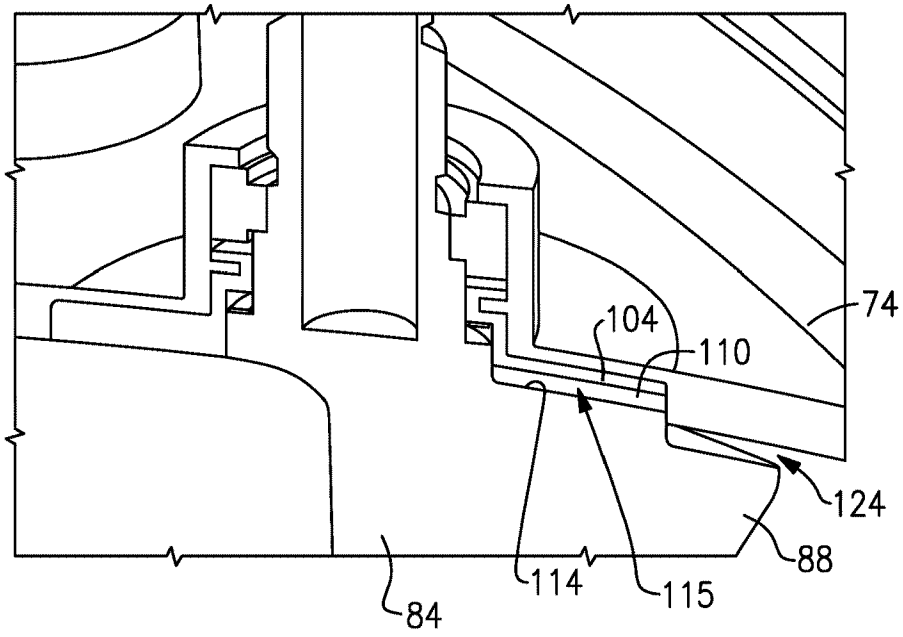
FIGS. 6A and 6B are perspective views of the variable vane similar to the sections shown in FIGS. 4A and 4B.
Figure 6A:
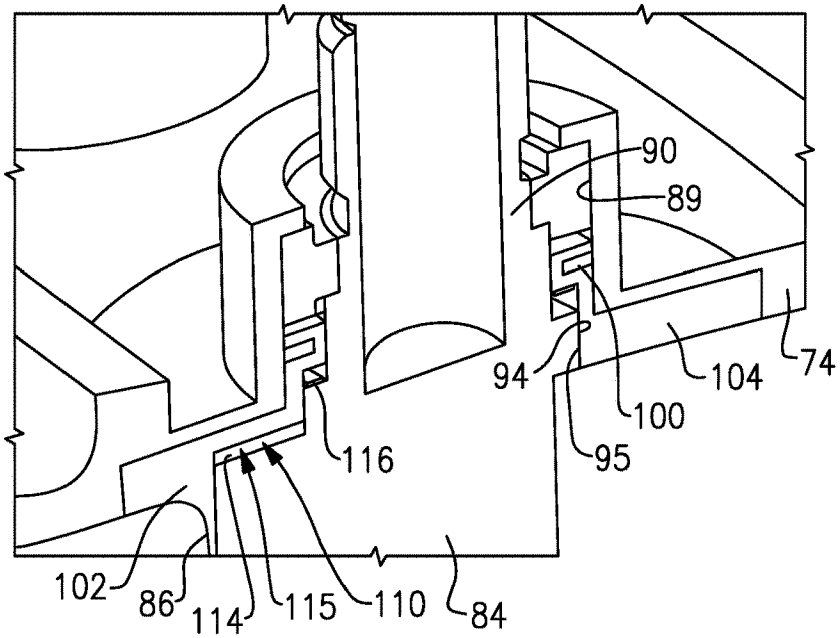
Figure 7:
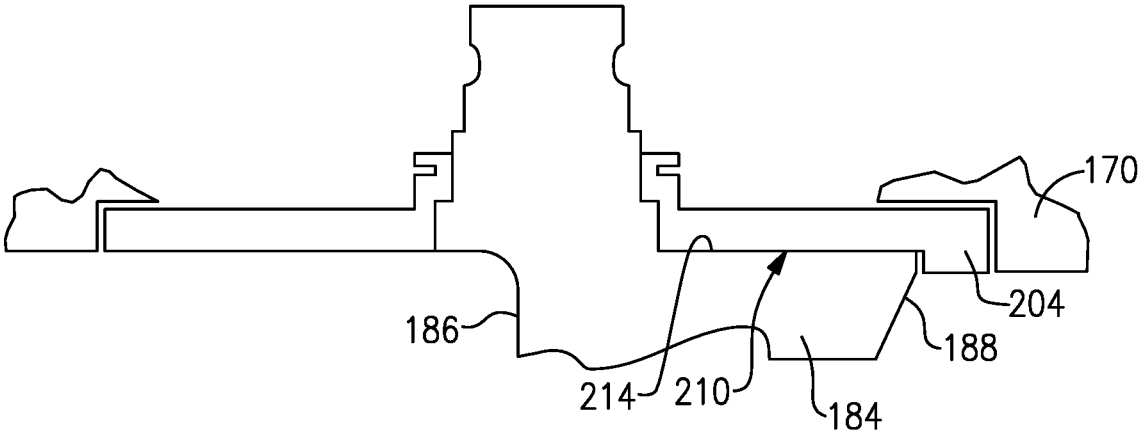
FIG. 7 is a cross-sectional view of another variable vane and insert arrangement.

Referring to FIGS. 4B and 6B, the diameter of the insert 104 may limited by the axial width of the supporting case structure. As a result, it may not be possible to provide a large enough insert 104 that can provide a pocket 110 able to accommodate the entire chord of the airfoil 84 from the leading edge 86 to the trailing edge 88. As a result, a notch 122 may be provided between the airfoil 84 near the trailing edge 88 and the outer case 74, which may create a small gap 124. FIG. 7 illustrates an arrangement in which the entire chord of the airfoil 184 (from leading edge 186 to trailing edge 188) is received within the pocket 210. As a result, the flow from the flowpath cannot easily penetrate the interfaces between the end 214 and the insert 204 and the engine static structure 170.

The disclosed variable vane assembly incorporates an insert in between the rotating vane and the case to minimize/eliminate the gap between the rotating vane and the inner and outer diameter vane platforms. A wave spring loads the insert against the platform and a pocket in the insert accommodates the vane body and allows for tolerance variation and relative thermal growth between the components. The spring loaded insert eliminates the vane to platform gap. Since the vane has to be able to rotate, the flowpath side of the insert needs to match the perimeter surface of the platform/flowpath, spherical in this case. Depending on the size and geometry of the vane and platform, the entire vane could fit into the insert completely eliminating the vane to platform gap. By eliminating this gap the turbine performance and efficiency could be considerably improved.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. The disclosed variable vane assembly may be used in any engine section, including the high pressure turbine. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A variable vane assembly for a gas turbine engine comprising:

a case having a bore and a recess, the case providing a first portion of a flow path surface;

a vane includes a journal extending along an axis from a vane end and received in the bore; and an insert arranged in the recess and providing a second portion of the flow path surface adjacent to the first flow path surface, the insert includes a pocket that slidably receives the vane end, the vane end is configured to move axially relative to the insert, wherein the insert includes opposing sides, and the pocket is provided on one side, and a neck is provided on the other side and includes an aperture through which the journal extends, the neck has a portion that extends radially inward into the aperture to provide a first face, and the journal includes a collar that provides a second face, a spring is arranged between the first and second faces and is configured to bias the insert and the vane end apart from one another.

2. The variable vane assembly of claim 1, wherein a circumferential groove is provided in the portion of the neck opposite the aperture, and a piston seal is received in the groove and engages the bore.

3. The variable vane assembly of claim 2, comprising a bearing or a bushing in the bore and supporting the journal for rotation relative to the case.

4. The variable vane assembly of claim 1, wherein the first and second portions of the flow path surfaces are flush with one another.

5. A variable vane assembly for a gas turbine engine comprising:

a case having a bore and a recess, the case providing a first portion of a flow path surface;

a vane includes a journal extending along an axis from a vane end and received in the bore; and an insert arranged in the recess and providing a second portion of the flow path surface adjacent to the first flow path surface, the insert includes a pocket that slidably receives the vane end, the vane end is configured to move axially relative to the insert, wherein a fillet circumscribes at least some of the pocket on a side of the insert, the fillet providing a transition from the second portion of the flow path surface to an exterior airfoil surface of the vane.

6. The variable vane assembly of claim 5, wherein the fillet provides at least one of a leading edge airfoil fillet and a trailing edge airfoil fillet.

7. The variable vane assembly of claim 1, wherein the insert is a different material than the vane.

8. The variable vane assembly of claim 1, wherein the case includes radially spaced apart inner and outer cases, and the vane has opposing ends, one of the recess is provided in each of the inner and outer cases include, and one of the insert is provided in each of the recesses with the pocket of each one of the recess receiving a respective one of the opposing ends.

9. An insert for a variable vane assembly comprising:

a body having a circular periphery and with opposing sides, a pocket is provided on one side, and a neck is provided on the other side and includes an aperture, the neck has a portion that extends radially inward into the aperture to provide an annular face, and a circumferential groove is provided in the portion of the neck opposite the aperture.

10. The insert of claim 9, wherein a fillet circumscribes at least some of the pocket on the one side.

11. The insert of claim 10, wherein the fillet is interrupted at the aperture.

12. The insert of claim 10, wherein the fillet provides a leading edge airfoil fillet.

13. The insert of claim 10, wherein the fillet provides a trailing edge airfoil fillet.

14. The insert of claim 9, wherein the neck is cylindrical in shape.

15. The insert of claim 9, wherein a piston seal is received in the circumferential groove.

16. The insert of claim 9, wherein the insert is constructed from a ceramic material.

17. A method of operating a variable vane assembly, comprising:

rotatably receiving a journal of a vane and an insert in a case, wherein the vane and insert are configured to rotate together with respect to the case, the insert and the case together providing a flow path surface; and biasing the insert and the vane radially apart with the end of the vane slidably received in a pocket of the insert.

18. The method of claim 17, comprising sealing the insert with respect to the case.

19. The method of claim 17, comprising carrying the journal with respect to the case with a bearing or bushing.

* * * * *